United States Patent [19]

Sulzer

[11] 4,270,288

[45] Jun. 2, 1981

[54] PICTURE FRAMES

[76] Inventor: Ernst Sulzer, Obere Geerenstrasse 48, 8044 Geeren, Kt. Zürich, Switzerland

[21] Appl. No.: 104,634

[22] Filed: Dec. 17, 1979

Related U.S. Application Data

[63] Continuation of Ser. No. 862,876, Dec. 21, 1977, abandoned.

[51] Int. Cl.[3] ..... G09F 1/12

[52] U.S. Cl. ..... 40/156; 40/10 D

[58] Field of Search ..... 40/156, 152, 152.1, 40/155, 158 R, 10 R, 10 D, 603

[56] References Cited

U.S. PATENT DOCUMENTS

| | | | |
|---|---|---|---|
| 1,742,378 | 1/1930 | Boese | 40/156 |
| 3,694,947 | 10/1972 | Mukai et al. | 40/152 |
| 3,981,091 | 9/1976 | Wiener | 40/156 X |
| 4,063,378 | 12/1977 | Burke | 40/156 |

FOREIGN PATENT DOCUMENTS

| | | | |
|---|---|---|---|
| 150702 | 9/1937 | Austria | 40/156 |

*Primary Examiner*—John F. Pitrelli
*Attorney, Agent, or Firm*—James C. Wray

[57] ABSTRACT

A picture frame comprising a transparent synthetic plastics plate with inclined edges, and a clamping member which snaps between the inclined edges and presses a picture against the transparent plate by spring action.

1 Claim, 7 Drawing Figures

PICTURE FRAMES

This is a continuation of application Ser. No. 862,876, filed Dec. 21, 1977, now abandoned.

BACKGROUND TO THE INVENTION

The invention relates to a picture frame in which pictures, drawings, photographs etc. can be exchanged easily and rapidly. Known picture frames are provided with a glass plate and with clamping members for the clamping retention and pressing of the picture with stiffening card on the back of the frame.

SUMMARY OF THE INVENTION

According to the invention there is provided a picture frame comprising: a transparent substantially rigid synthetic frame plate of one thickness having an inside surface against which a picture to be framed is locatable, angle pieces disposed along two mutually remote sides of said frame plate and formed integrally therewith, said angle pieces extending at the inside surface and inclining towards each other in the extending direction, a flexible clamping plate of a thickness substantially less than the thickness of the frame plate having an area substantially less than the area of the frame plate and having a length just shorter than the distance between said angle pieces so as to permit location of said clamping plate between said angle pieces, and further angle pieces extending along the ends of said clamping plate and formed integrally with said clamping plate, said further angle pieces extending at an exterior surface of said clamping plate and inclining towards each other in the extending direction, wherein upon entry of the clamping plate into the frame plate the clamping plate is depressed by the user substantially in a direction perpendicular to the frame plate whereupon as the clamping plate enters the frame plate the clamping plate temporarily deforms into a curved shaped and after entry assumes a position lying adjacent the frame plate, with the picture disposed between said frame plate and clamping plate, and with said further angle pieces of said clamping plate engaging the angle pieces of said frame plate, said clamping plate being removable from said frame plate by finger force acting substantially perpendicular to the frame plate to once again temporarily deform the clamping plate.

BRIEF DESCRIPTION OF DRAWINGS

Two examples of the invention are illustrated in the accompanying drawings, wherein.

DESCRIPTION OF PREFERRED EMBODIMENTS

Figure 2:
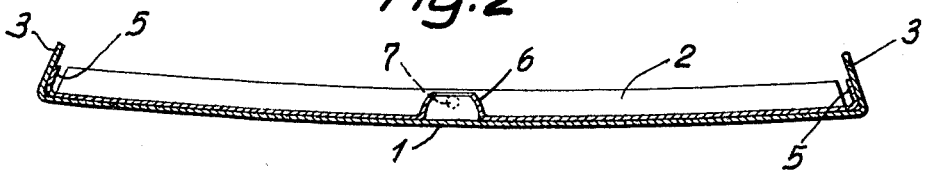
FIG. 2 shows a section along the line II—II in FIG. 1.
Figure 1:
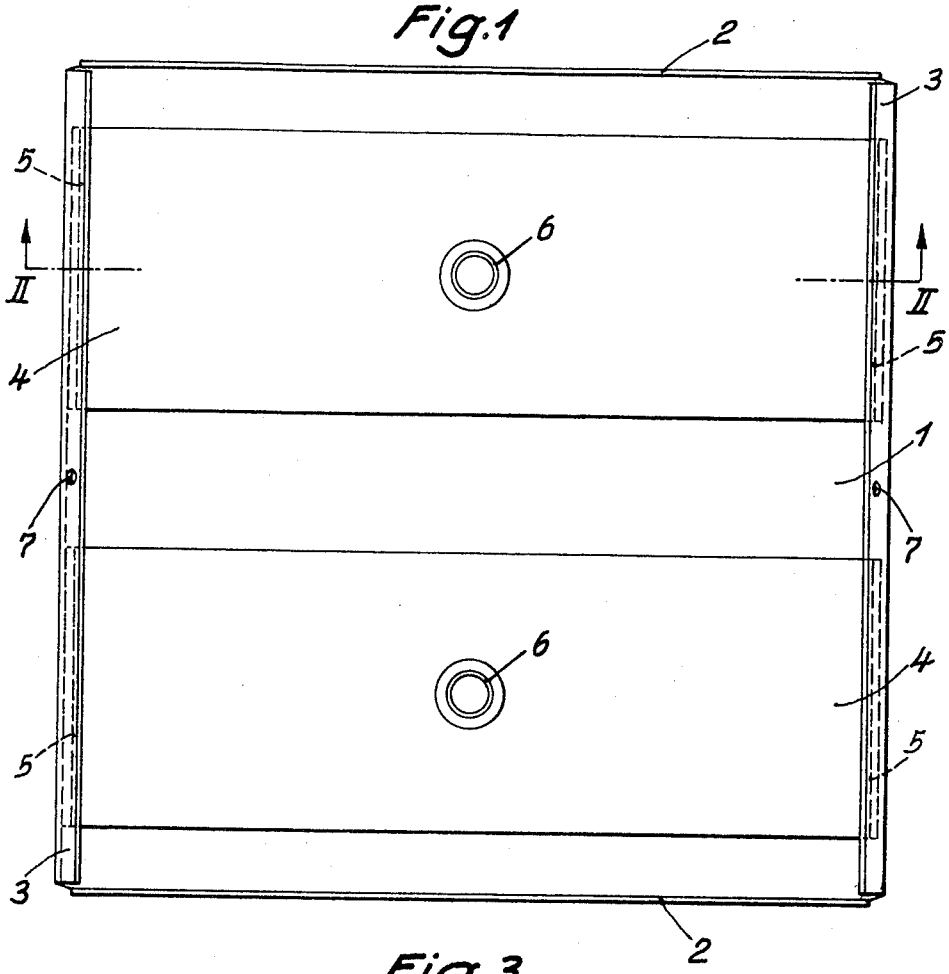
FIG. 1 shows a view of a first form of embodiment of the picture frame from the rear.
Figure 3:
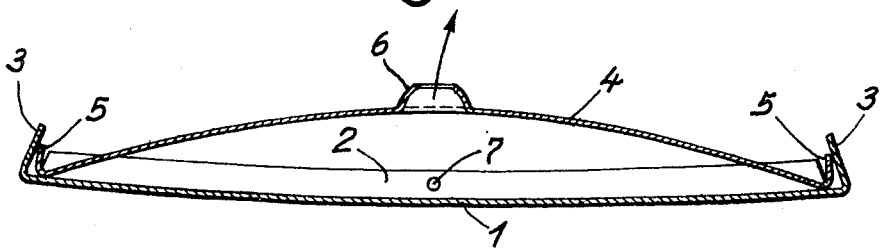
FIG. 3 shows a section similar to FIG. 2 in the unclamping of the picture.
Figure 5:
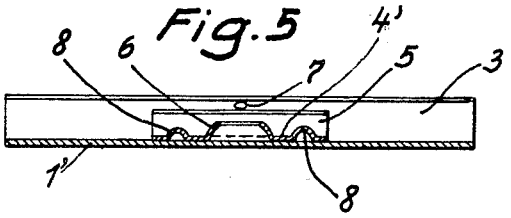
FIG. 5 shows a section along the line V—V in FIG. 4.
Figure 7:
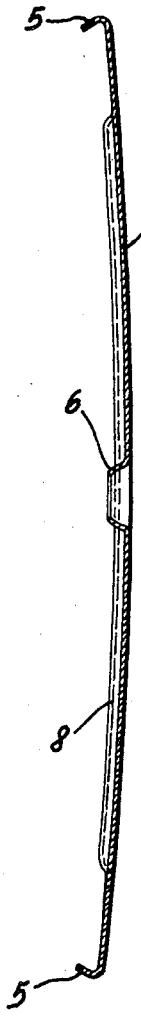
FIG. 7 shows a lateral elevation of the arcuate resilient clamping member.

The picture frame according to FIGS. 1 to 3 comprises a rectangular, transparent, synthetic plastics plate 1 which is a curve in arcuate form, as illustrated in FIGS. 2 and 3. The mutually remote end edges 2 of the plate 1 are bent off at right angles and form stiffening ribs for the stabilisation of the curvature of the plate 1. The other two plate side edges 3 are angled off inwards and form an internal angle $\alpha$ of app. 70° with the plate 1.

The picture (not shown in the drawing) to be clamped into the picture frame is laid upon the back of the plate 1 and covered for example by a card (not shown in the drawing). For the pressing down of the picture and of the card serving for its covering there serve two resiliently flexible clamping plates 4 of elongated form, the short edges 5 of which are likewise angled off inwards. The clamping plates 4 are flat in the relaxed condition, are curved by the edges 5 bearing against the edges 3 of the plate 1 in fitting into the curved frame, and hold the covering card and picture in abutment on the back of the transparent plate 1. The clamping plates 4 are provided in the center with a hollow grip 6 for the insertion of a finger and lifting out or exchange of the picture. FIG. 3 shows the position of a clamping plate 4 in the exchanging of a picture, in the partially lifted-out, resiliently curved position. The angled-off edges 2, 3 can be provided with eyes 7 for the suspension of the changing frame on a wall by means of a nail or hook.

Figure 6:
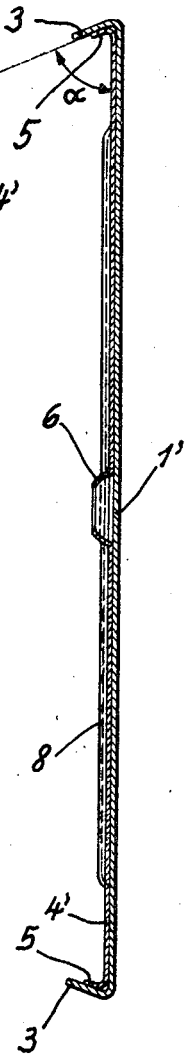
FIG. 6 shows a section along the line VI—VI in FIG. 4.
Figure 4:
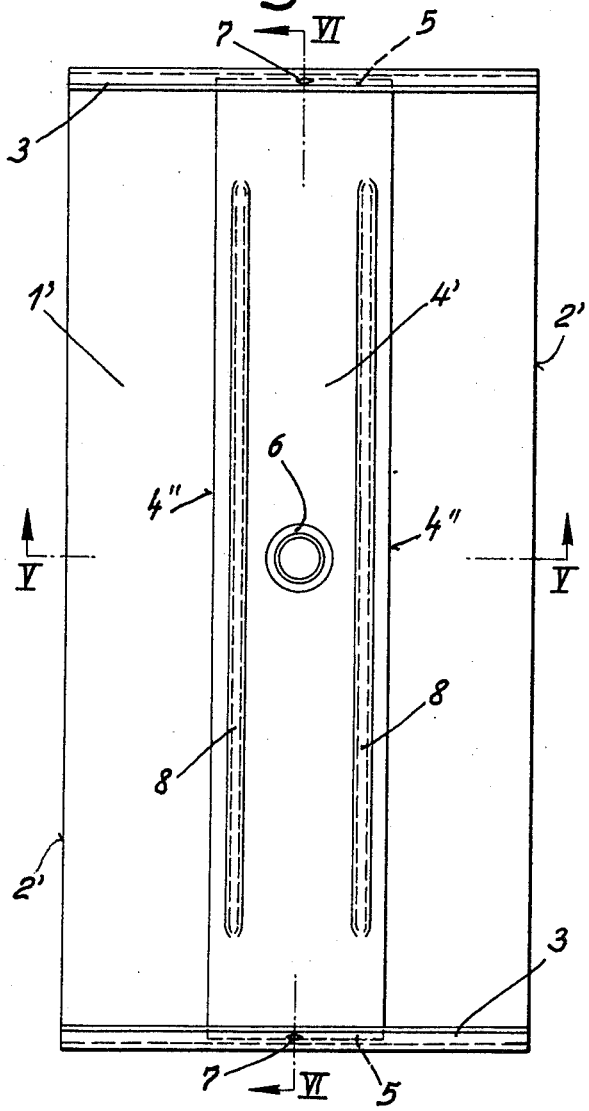
FIG. 4 shows a rear view of a second form of embodiment of the picture frame.

While the picture frame according to FIGS. 1 to 3 possesses a square to rectangular format and can be suspended with its edge angled pieces either 2 or 3, the picture frame as illustrated in FIGS. 4 to 7 has an upright format, and the longitudinal edges 2' of the transparent syntehtic plastics plate 1' are not angled off. On the other hand the short edges 3 are angled inwards, as in FIG. 2, and form an internal angle of app. 70° with the plate 1' (FIG. 6). The picture to be clamped into the picture frame is inserted, in this example of embodiment again, on the back visible in FIG. 4 of the frame plate 1' and covered by a card. For the pressing down of the picture and of the card serving for its covering there serves a resiliently flexible clamping plate 4' of elongated form which is provided with two stiffening ribs 8 running lengthwise. The short edges 5 of this clamping plate 4' are again bent over at an angle $\alpha$ of 70° (FIG. 6). The frame plate 1' consists of thicker material than the clamping plate 4' and possesses a flat form, while the clamping plate 4' is arcuately curved in its length (FIG. 7) and its curvature is slightly stabilised by the stiffening ribs 8. In the insertion of the clamping plate 4' the application pressure of the angled pieces 5 of the clamping plate 4' against the angled pieces 3 of the frame plate 1' effect bending of the clamping plate 4' to the flat form of the frame plate 1' and thus pressing of the clamping plate against the frame plate.

The frame plate 1, 1' can be provided with a mat surface to avoid reflection. The clamping plates 4, 4' can consist, like the frame plates, of synthetic plastics material or another resilient material, for example of metal springs. In place of the ribs 8, for the stiffening of the clamping plate 4' its longitudinal edges 4'' can likewise be provided with angled-off pieces 5 which advantageously extend at right angles to the plane of the clamping plate.

I claim:

1. A picture frame comprising:

(a) a transparent substantially rigid synthetic frame plate of one thickness having an inside surface against which a picture to be framed is locatable, said frame plate comprises an arcuate surface for the support of said picture, (b) angle pieces disposed along two mutually remote sides of said frame plate and formed integrally therewith, said angle pieces extending at the inside surface and inclining towards each other in the extending direction, said frame plate has two further mutually remote sides and has stiffening means comprising further edge angled pieces integral with said frame plate on said two mutually remote sides, the angled pieces of the frame plate include with the frame plate an acute angle of approximately 70°, (c) a flexible clamping plate of a thickness substantially less than the thickness of the frame plate having an area substantially less than the area of the frame plate and having a length just shorter than the distance between said angle pieces so as to permit location of said clamping plate between said angle pieces, stiffening means on said clamping plate extending longitudinally therealong, whereby in the unassembled condition of the frame the clamping plate resides in an arcuate form said further angle pieces of said clamping plate include an angle of approximately 70°, and (d) further angle pieces extending along the ends of said clamping plate and formed integrally with said clamping plate, said further angle pieces extending at an exterior surface of said clamping plate and inclining towards each other in the extending direction, wherein upon entry of the clamping plate into the frame plate the clamping plate is depressed by the user substantially in a direction perpendicular to the frame plate whereupon as the clamping plate enters the frame plate the clamping plate temporarily deforms into a curved shape and after entry assumes a position lying adjacent the frame plate, with the picture disposed between said frame plate and clamping plate, and with said further angle pieces of said clamping plate engaging the angle pieces of said frame plate, said clamping plate being removable from said frame plate by finger force acting substantially perpendicular to the frame plate to once again temporarily deform the clamping plate.

* * * * *